US007797868B1

(12) United States Patent
Cobb et al.

(10) Patent No.: US 7,797,868 B1
(45) Date of Patent: Sep. 21, 2010

(54) SIGN ASSEMBLY HAVING ARCUATE NESTING COMPONENT

(75) Inventors: Ron Cobb, Atlanta, GA (US); Ben Bell, Avondale Estates, GA (US)

(73) Assignee: APCO Graphics, Inc., Atlanta, GA (US)

( * ) Notice: Subject to any disclaimer, the term of this patent is extended or adjusted under 35 U.S.C. 154(b) by 890 days.

(21) Appl. No.: 11/646,942

(22) Filed: Dec. 29, 2006

(51) Int. Cl.
*G09F 15/00* (2006.01)

(52) U.S. Cl. ..... 40/606.12; 40/606.18; 40/607.02; 40/607.11

(58) Field of Classification Search ..... 40/606.12, 40/606.18, 607.01, 607.02, 607.11, 605, 40/611.01, 611.08; D20/41
See application file for complete search history.

(56) References Cited

U.S. PATENT DOCUMENTS

| | | | | | |
|---|---|---|---|---|---|
| D89,867 | S | * | 5/1933 | Bishop | D20/41 |
| 3,116,027 | A | | 12/1963 | Kleppin | |
| 3,182,414 | A | | 5/1965 | Snediker | |
| 3,712,005 | A | | 1/1973 | Eschbach et al. | |
| 4,068,398 | A | * | 1/1978 | Parisi | 40/607.02 |
| 4,084,338 | A | | 4/1978 | Ross | |
| 4,276,706 | A | * | 7/1981 | Scott | 40/607.11 |
| 4,408,407 | A | * | 10/1983 | Bloom et al. | 40/611.05 |
| 4,641,448 | A | * | 2/1987 | Cobb et al. | 40/607.02 |
| 4,785,565 | A | | 11/1988 | Kuffner | |
| 4,802,296 | A | | 2/1989 | Kovalak, Jr. | |
| 4,811,508 | A | * | 3/1989 | Engelbach | 40/607.11 |
| 5,012,603 | A | | 5/1991 | Elcock | |
| D324,576 | S | | 3/1992 | Bell | |
| 5,355,603 | A | | 10/1994 | Luikkonen | |
| D395,677 | S | | 6/1998 | Gongora et al. | |
| D403,360 | S | | 12/1998 | Cobb et al. | |
| 5,966,857 | A | | 10/1999 | Pettersson et al. | |
| 6,293,035 | B1 | * | 9/2001 | LaPointe | 40/607.12 |
| 6,493,975 | B1 | | 12/2002 | Cobb et al. | |
| D470,892 | S | | 2/2003 | Linko, Sr. | |
| 6,530,167 | B1 | | 3/2003 | Schuetz et al. | |
| 6,898,882 | B2 | * | 5/2005 | Kim | 40/607.1 |
| 2006/0086025 | A1 | | 4/2006 | Benedict et al. | |

* cited by examiner

*Primary Examiner*—Gary C Hoge
(74) *Attorney, Agent, or Firm*—Chambliss, Bahner & Stophel, P.C.

(57) ABSTRACT

A sign assembly having a sign post, a first arcuate nesting component and a first sign panel. The sign post has a sign post perimeter, a sign post longitudinal axis and a sign post elongated slot extending substantially parallel to the longitudinal axis. The first arcuate nesting component is adapted to be secured to the sign post. The first sign panel is adapted to be retained by the first arcuate nesting component. The sign post and the first arcuate nesting component are configured and arranged such that when the first arcuate nesting component is secured to the sign post there is substantially no gap between the first sign panel and the sign post, and the first arcuate nesting component extends around a portion of the sign post perimeter.

22 Claims, 9 Drawing Sheets

FIGURE 10
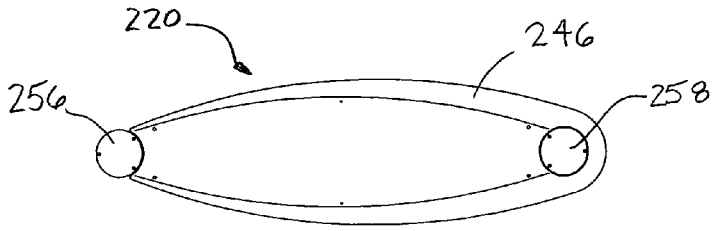
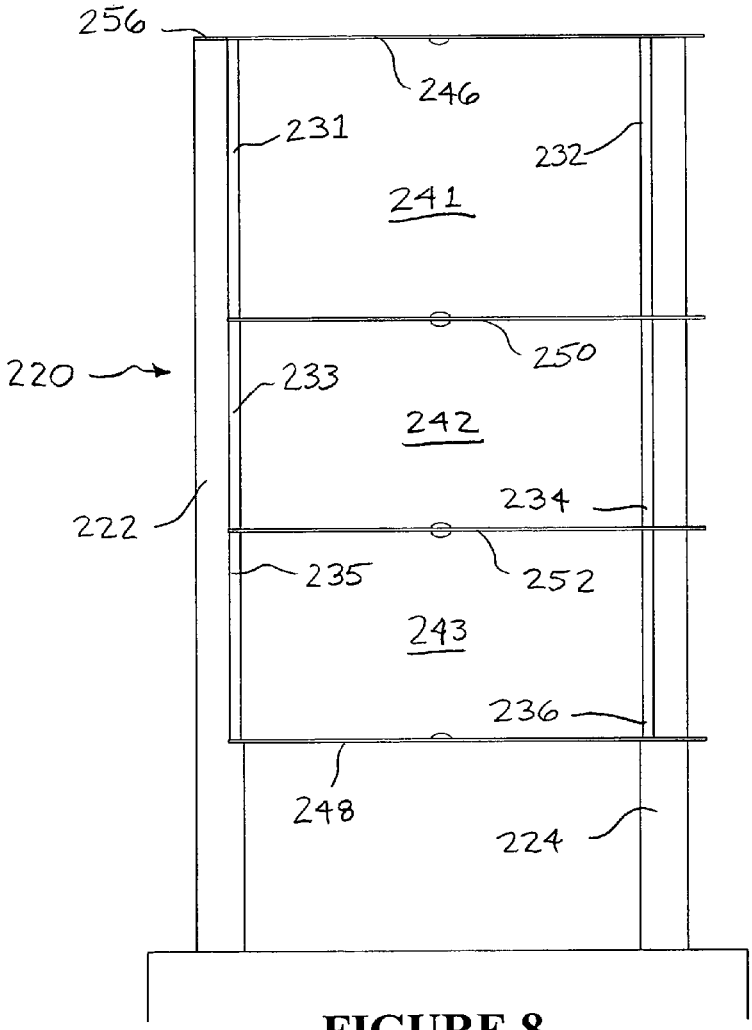
FIGURE 8
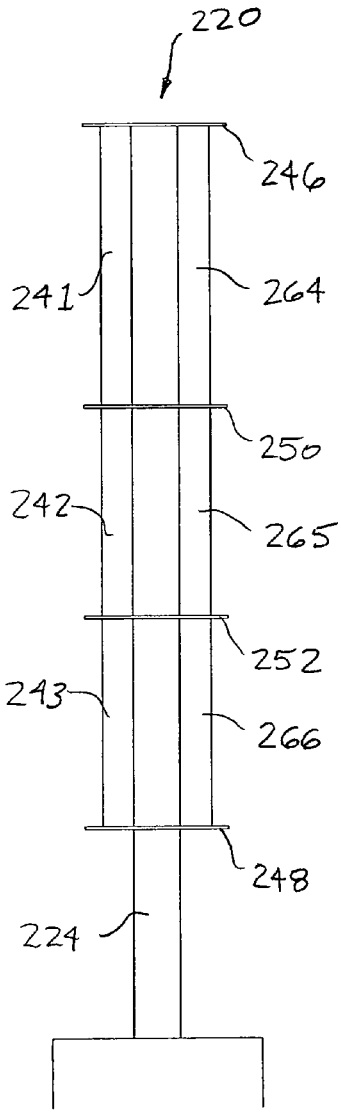
FIGURE 9

SIGN ASSEMBLY HAVING ARCUATE NESTING COMPONENT

FIELD OF THE INVENTION

The present invention relates generally to post and panel sign assemblies, and particularly to post and panel sign assemblies utilizing a nesting component to secure a sign panel to a sign post.

BACKGROUND AND DESCRIPTION OF THE PRIOR ART

Conventional post and panel sign assemblies utilize nesting components that are adapted to retain a sign panel and be secured to a sign post. See, e.g., U.S. Pat. No. 4,802,296 of Kovalak, Jr.; U.S. Pat. No. 5,012,603 of Elcock; and U.S. Pat. No. 6,493,975 of Cobb et al. However, the nesting components utilized by conventional post and panel sign assemblies suffer from several disadvantages. For example, nesting components utilized by conventional post and panel sign assemblies are not arcuate in configuration. As a result, conventional nesting components do not sufficiently extend around the perimeter of the sign post. In addition, conventional nesting components do not sufficiently extend along the length of an end of the sign panel. Because conventional nesting components do not sufficiently extend along the length of an end of the sign panel or sufficiently extend around the perimeter of the sign post, they do not provide the sign assembly with sufficient structural stability and strength, and they produce a gap between the end of the sign panel and the sign post. Further, conventional post and panel sign assemblies utilizing nesting components do not sufficiently deflect air loads.

It would be desirable, therefore, if an apparatus could be provided that includes one or more arcuate nesting components. It would also be desirable if such an apparatus could be provided that includes one or more arcuate nesting components that extend around a portion of the perimeter of the sign post. It would be further desirable if such an apparatus could be provided that includes one or more arcuate nesting components that extend substantially along the length of an end of the sign panel. It would be still further desirable if such an apparatus could be provided that would improve the structural stability and strength of the sign assembly. It would also be desirable if such an apparatus could be provided that would have substantially no gap between the end of the sign panel and the nearest sign post. It would be further desirable if such an apparatus could be provided that would deflect air loads.

ADVANTAGES OF THE PREFERRED EMBODIMENTS OF THE INVENTION

Accordingly, it is an advantage of the preferred embodiments of the invention claimed herein to provide a sign assembly having one or more arcuate nesting components. It is another advantage of the preferred embodiments of the invention to provide a sign assembly having one or more arcuate nesting components that extend around a portion of the perimeter of the sign post. It is also an advantage of the preferred embodiments to provide a sign assembly having one or more arcuate nesting components that extend substantially along the length of an end of the sign panel. It is a further advantage of the preferred embodiments of the invention to provide a sign assembly having improved structural stability and strength. It is a still further advantage of the preferred embodiments to provide a sign assembly having substantially no gap between the end of the sign panel and the nearest sign post. It is yet another advantage of the preferred embodiments of the invention to provide a sign assembly that deflects air loads.

Additional advantages of the invention will become apparent from an examination of the drawings and the ensuing description.

Explanation of Technical Terms

As used herein, the term "arcuate nesting component" includes nesting components that are generally curved in a circular manner so as to extend around a portion of the perimeter of a cylindrical sign post. It is contemplated within the scope of the invention that the term "arcuate nesting component" may also include nesting components that are sloped, angled, bent or otherwise configured so as to extend around a portion of the perimeter of a sign post having a cross-sectional shape other than a circle such as an oval, an ellipse, a square, a rectangle, a pentagon, a hexagon, an octagon and the like.

As used herein, the term "post perimeter" refers to the cross-sectional outer boundary of a sign post as that term is defined below, regardless of the cross-sectional shape of the sign post. By way of example, and without limitation, the "post perimeter" of a cylindrical sign post is defined by the circular cross-sectional shape of the sign post.

As used herein, the term "sign panel" includes sign panels that are substantially square or rectangular in shape. It is also contemplated within the scope of the invention that the term "sign panel" may include sign panels having one or more sides that are arcuate, sloped or any other suitable non-linear configuration. It is further contemplated within the scope of the invention that the term "sign panel" may include both planar and non-planar sign panels.

As used herein, the term "sign post" includes support structures having a circular, ovate, elliptical, contoured, square, rectangular, pentagonal, hexagonal, octagonal or any other suitable cross-sectional shape. It is contemplated within the scope of the invention that the term "sign post" may include a support structure that is disposed substantially vertically from its base or disposed at any angle relative to its base. It is further contemplated that the term "sign post" may include a plurality of support structures that are disposed parallel to each other or at an angle relative to each other.

SUMMARY OF THE INVENTION

The invention comprises a sign assembly having a first sign post, a first arcuate nesting component and a first sign panel. The first sign post has a first sign post perimeter and a first sign post longitudinal axis. The first arcuate nesting component is adapted to be secured to the first sign post. The first sign panel has a first sign panel first end and a first sign panel second end and is adapted to be retained by the first arcuate nesting component. Further, the first sign post and the first arcuate nesting component are configured and arranged such that when the first arcuate nesting component is secured to the first sign post there is substantially no gap between the first sign panel first end and the first sign post, and the first arcuate nesting component extends around a portion of the first sign post perimeter.

In the preferred embodiment of the invention, the first sign post further includes a first sign post elongated slot extending substantially parallel to the first sign post longitudinal axis. The preferred first arcuate nesting component is adapted to be slidingly received and removably secured by the first sign post elongated slot. Also in the preferred embodiment, the sign assembly further comprises a second sign post, a second arcuate nesting component, a first support rib, a second support rib and a second sign panel. More particularly, the preferred second sign post has a second sign post perimeter, a second sign post longitudinal axis and a second sign post elongated slot extending substantially parallel to the second sign post longitudinal axis. The preferred second arcuate nesting component is adapted to be slidingly received and removably secured by the second sign post elongated slot. The preferred first support rib has a first support rib first end and a first support rib second end, and the preferred second support rib has a second support rib first end and a second support rib second end. The preferred second sign panel has a second sign panel first end and a second sign panel second end.

Further, in the preferred embodiment of the invention, the first sign panel first end, the second sign panel first end, the first support rib first end and the second support rib first end are adapted to be retained by the first arcuate nesting component. Also in the preferred embodiment, the first sign panel second end, the second sign panel second end, the first support rib second end and the second support rib second end are adapted to be retained by the second arcuate nesting component. Still further, in the preferred embodiment, the first sign post and the first arcuate nesting component are configured and arranged such that when the first arcuate nesting component is slidingly received and removably secured by the first sign post elongated slot there is substantially no gap between the first sign panel first end and the first sign post, there is substantially no gap between the second sign panel first end and the first sign post, and the first arcuate nesting component extends around a substantial portion of the first sign post perimeter. Similarly, in the preferred embodiment, the second sign post and the second arcuate nesting component are configured and arranged such that when the second arcuate nesting component is slidingly received and removably secured by the second sign post elongated slot there is substantially no gap between the first sign panel second end, there is substantially no gap between the second sign panel second end and the second sign post, and the second sign post and the second arcuate nesting component extends around a substantial portion of the second sign post perimeter.

BRIEF DESCRIPTION OF THE DRAWINGS

The presently preferred embodiments of the invention are illustrated in the accompanying drawings, in which like reference numerals represent like parts throughout, and in which:

FIG. 8 is a front view of a second alternative embodiment of the sign assembly in accordance with the present invention.

FIG. 9 is a right side view of the second alternative embodiment of the sign assembly illustrated by FIG. 8.

FIG. 10 is a top view of the second alternative embodiment of the sign assembly illustrated by FIGS. 8-9.

DESCRIPTION OF THE PREFERRED EMBODIMENTS OF THE INVENTION

Figure 1:
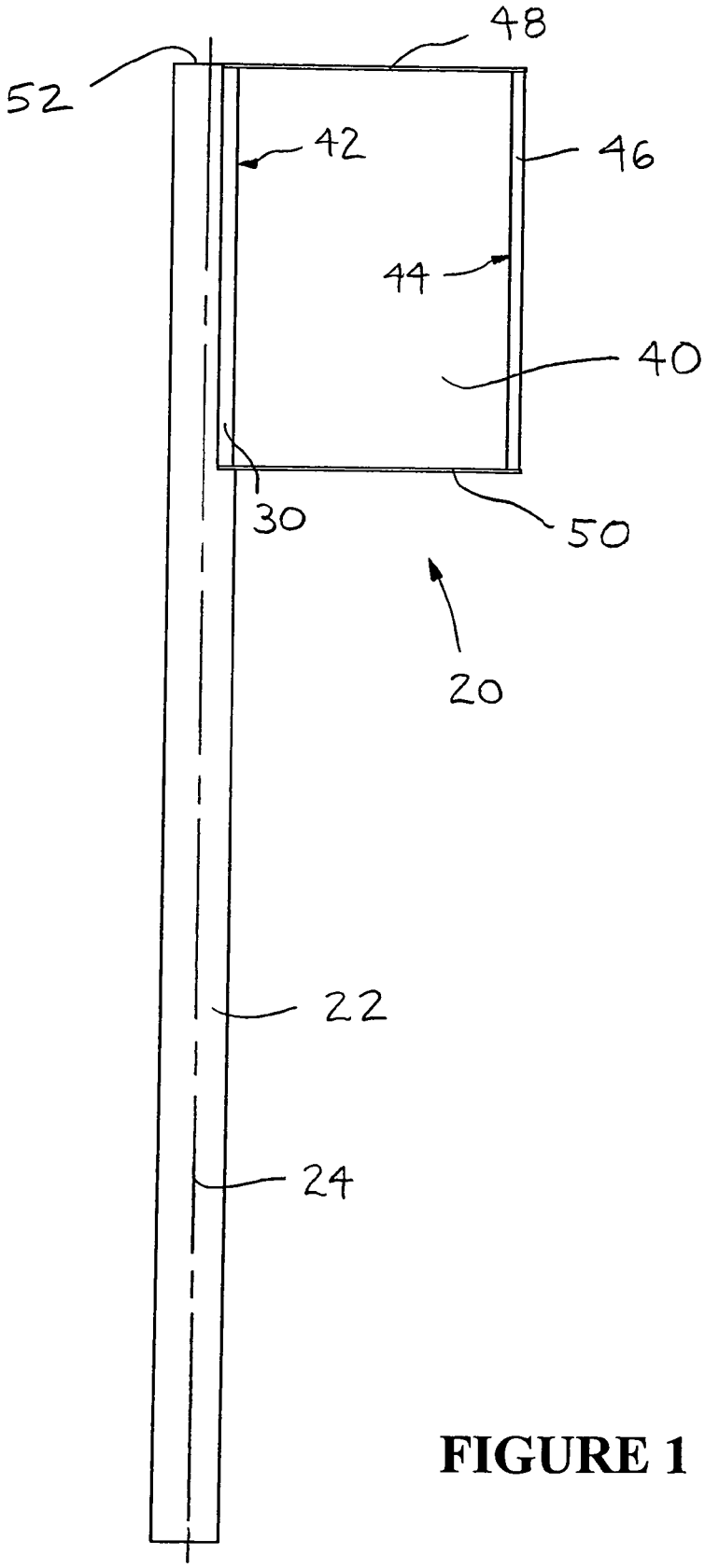
FIG. 1 is a front view of a preferred embodiment of the sign assembly in accordance with the present invention.

Referring now to the drawings, the preferred embodiments of the sign assembly in accordance with the present invention are illustrated by FIGS. 1 through 11. FIG. 1 is a front view of a preferred embodiment of the sign assembly in accordance with the present invention. As shown in FIG. 1, the preferred sign assembly is designated generally by reference numeral 20. More particularly, the preferred sign assembly 20 includes first sign post 22 having first sign post perimeter 23 (see FIGS. 2 and 3), first sign post longitudinal axis 24 and first sign post elongated slot 26 (see FIGS. 2 and 3) which extends substantially parallel to the first sign post longitudinal axis. Preferred sign assembly 20 also includes first arcuate nesting component 30 (see also FIGS. 2 and 3) which is adapted to be slidingly received and removably secured by first sign post elongated slot 26. It is contemplated within the scope of the invention, however, that the preferred sign post does not include an elongated slot and that the preferred arcuate nesting component is secured to the sign post by means other than being slidingly received and removably retained by a sign post elongated slot. For example, and without limitation, it is contemplated within the scope of the invention that the preferred arcuate nesting component may be welded to a sign post or fastened to a sign post by means such as threaded fasteners, rivets, adhesives and the like. It is further contemplated within the scope of the invention that the preferred arcuate nesting component may be adapted to be snap-fitted or press-fitted into an elongated slot or some other opening on a sign post such as a hole, a keyhole, a groove, a channel and the like.

Still referring to FIG. 1, the preferred first arcuate nesting component 30 extends substantially along the first sign panel first end. See also FIG. 3. It is contemplated within the scope of the invention, however, that the preferred arcuate nesting components do not extend substantially along an end of a sign panel. Preferred sign assembly 20 further includes first sign panel 40 which has first sign panel first end 42 and first sign panel second end 44. The preferred first sign panel 40 is adapted to be retained by first arcuate nesting component 30 (see also FIGS. 2 and 3). The preferred sign assembly 20 also includes bracket 46 (see also FIGS. 2 and 3), sign panel top plate 48 (see also FIG. 3), sign panel bottom plate 50 (see also FIG. 3) and sign post end cap 52 (see also FIG. 3).

Figure 2:
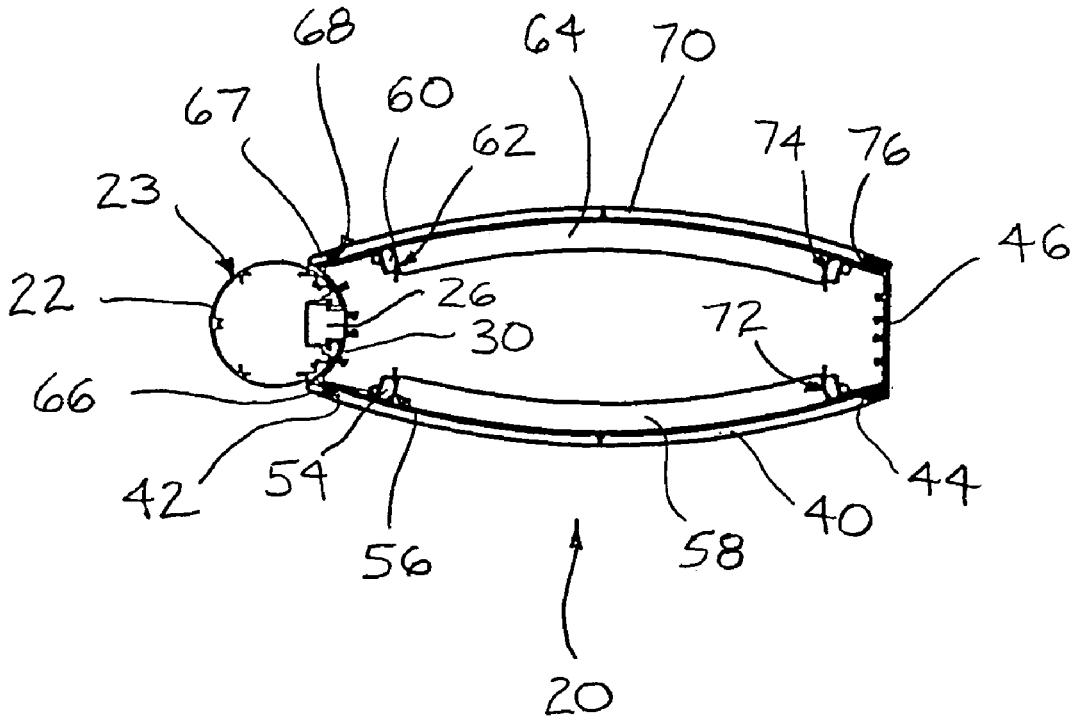
FIG. 2 is a top sectional view of the preferred embodiment of the sign assembly illustrated by FIG. 1.

Referring now to FIG. 2, a top sectional view of preferred sign assembly 20 is illustrated. As shown in FIG. 2, the preferred first arcuate nesting component 30 includes first arcuate nesting component first arm 54 which is adapted to secure the first end 56 of first support rib 58 and first arcuate nesting component second arm 60 which is adapted to secure the first end 62 of second support rib 64. The preferred first arcuate nesting component 30 also includes first arcuate nesting component first flange 66 which is adapted to secure first sign panel first end 42 and a first arcuate nesting component second flange 67 adapted to secure first end 68 of second sign panel 70. The preferred bracket 46 is adapted to secure second end 72 of first support rib 58, second end 74 of second support rib 64, first sign panel second end 44 and second end 76 of second sign panel 70. In the preferred embodiments of the sign assembly, the arcuate nesting components and bracket are adapted to removably secure the sign panels and support ribs. However, it is contemplated within the scope of the invention that the arcuate nesting components and/or the bracket are adapted to fixedly secure the sign panels and support ribs.

Still referring to FIG. 2, the preferred first sign post 22 and the preferred first arcuate nesting component 30 are configured and arranged such that when the first arcuate nesting component is slidingly received and removably secured by first sign post elongated slot 26 there is substantially no gap between first sign panel first end 42 and first sign post 22. As one having ordinary skill in the art may appreciate, the preferred sign assembly 20 is adapted to deflect air and wind loads. As shown in FIG. 2, the preferred first arcuate nesting component 30 extends around a portion of first sign post perimeter 23. In the preferred embodiment of sign assembly 20, the first arcuate nesting component extends around a substantial portion of the first sign post perimeter. In a more preferred embodiment, the first arcuate nesting component extends around at least about 150° of the first sign post perimeter.

Figure 3:
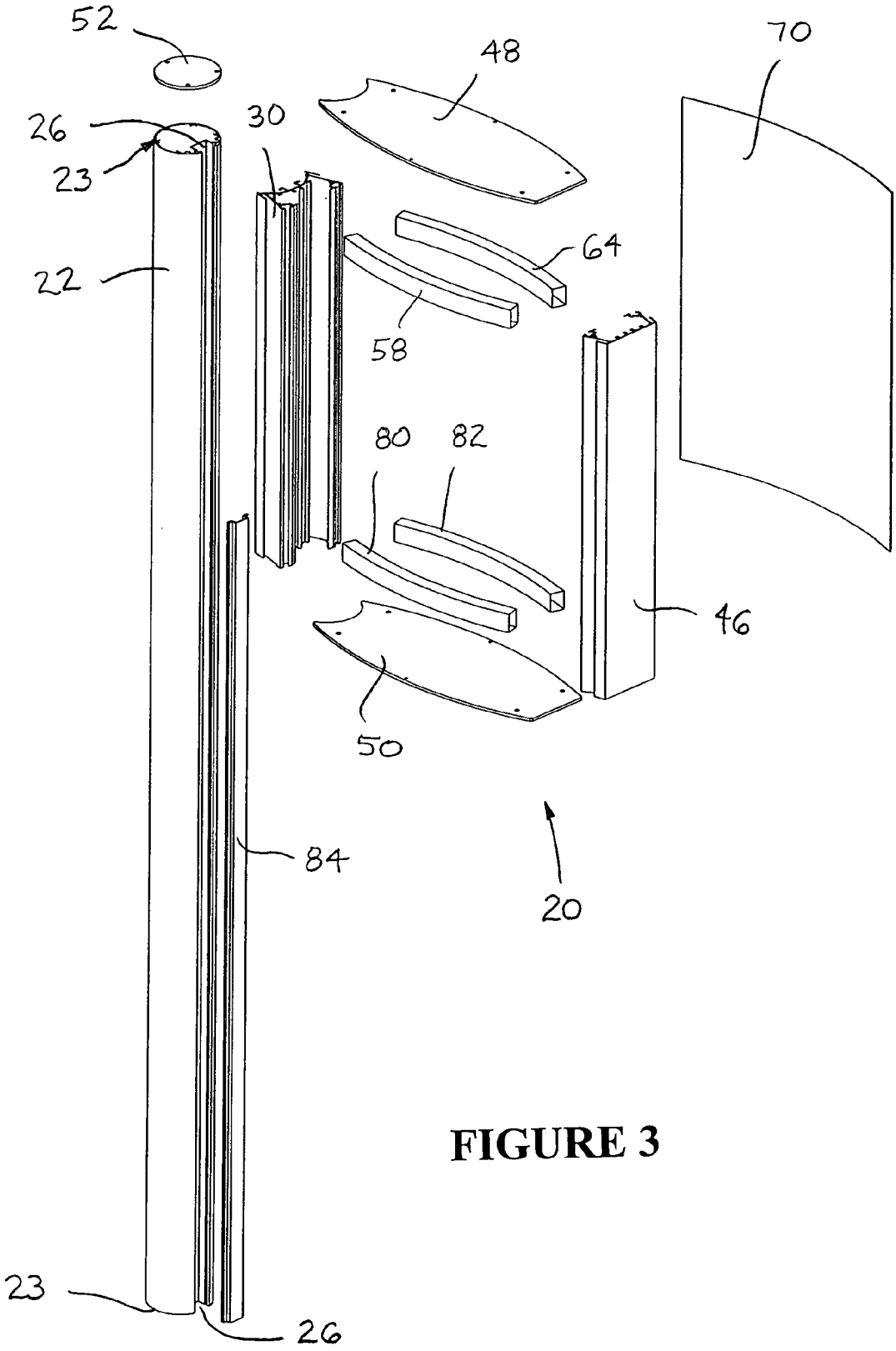
FIG. 3 is an exploded view of the preferred embodiment of the sign assembly illustrated by FIGS. 1-2.

Referring now to FIG. 3, an exploded view of preferred sign assembly 20 is illustrated. As shown in FIG. 3, preferred sign assembly 30 further includes third support rib 80, fourth support rib 82 and filler 84 which is adapted to be slidingly received by first sign post elongated slot 26 and provide vertical support to first arcuate nesting component 30.

Figure 4:
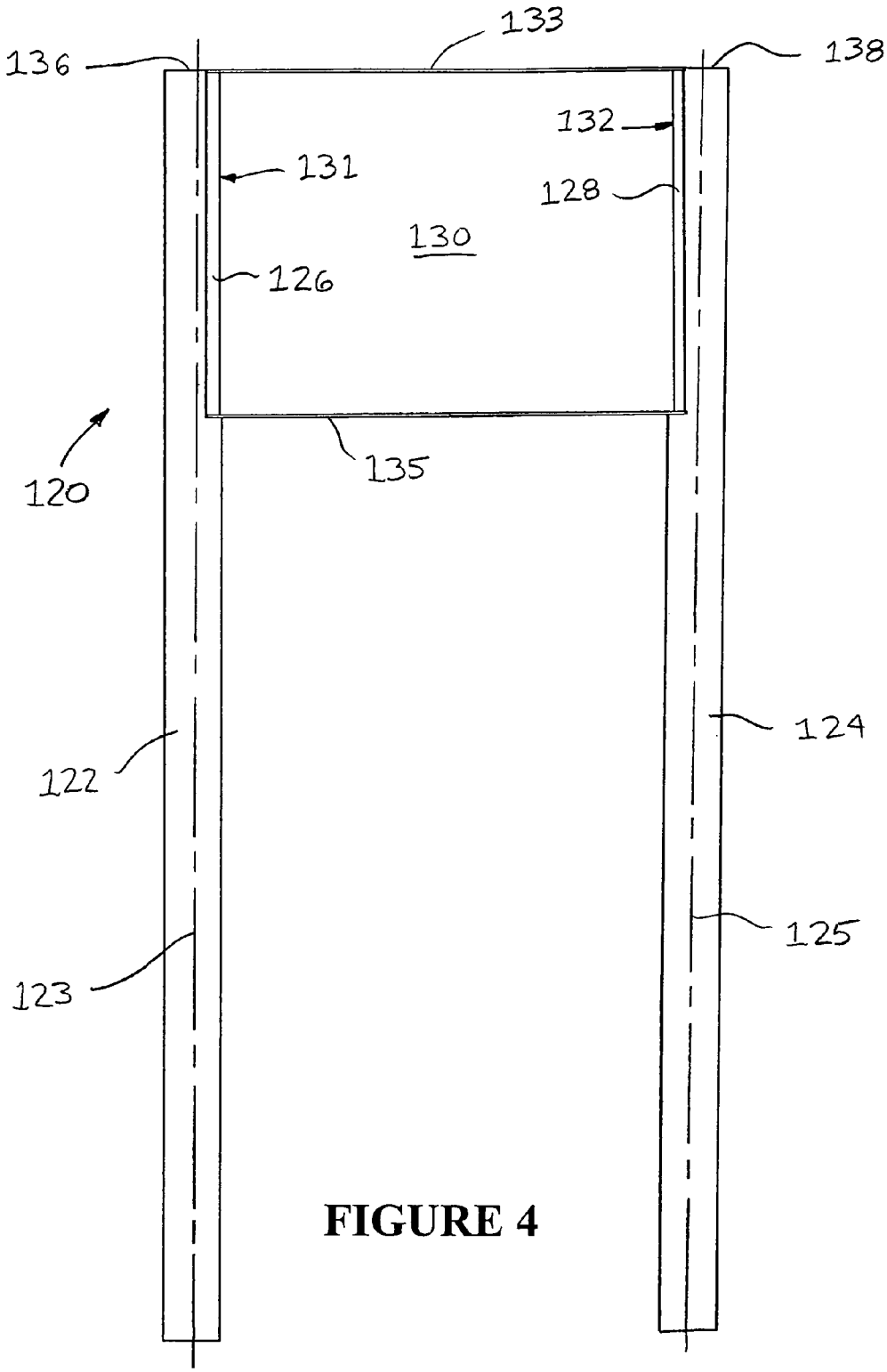
FIG. 4 is a front view of a first alternative embodiment of the sign assembly in accordance with the present invention.

Referring now to FIG. 4, a front view of a first alternative embodiment of the sign assembly in accordance with the present invention is illustrated. As shown in FIG. 4, the first alternative embodiment is designated generally by reference numeral 120. More particularly, preferred sign assembly 120 includes a first sign post 122 having first sign post longitudinal axis 123, second sign post 124 having second sign post longitudinal axis 125, first arcuate nesting component 126, second arcuate nesting component 128, first sign panel 130 having first sign panel first end 131 and first sign panel second end 132, sign panel top plate 133, sign panel bottom plate 135, first sign post end cap 136, and second sign post end cap 138. As shown in FIG. 4, first arcuate nesting component 126 extends substantially along first sign panel first end 131 and second arcuate nesting component 128 extends substantially along first sign panel second end 132.

Figure 5:
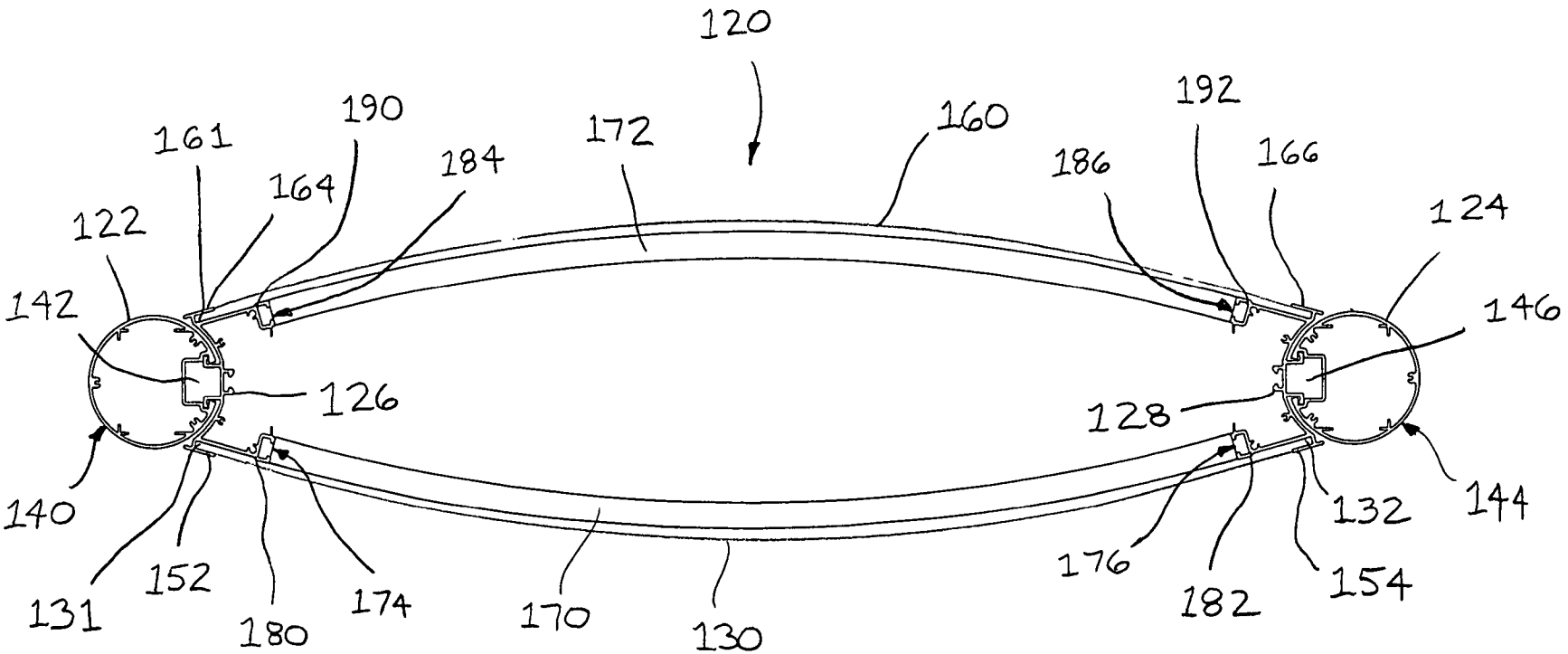
FIG. 5 is a top sectional view of the first alternative embodiment of the sign assembly illustrated by FIG. 4.

Referring now to FIG. 5, a top sectional view of preferred sign assembly 120 is illustrated. As shown in FIG. 5, preferred first sign post 122 has first sign post perimeter 140 and first sign post elongated slot 142 which extends substantially parallel to first sign post longitudinal axis 123 (see FIG. 4). The preferred second sign post 124 has second sign post perimeter 144 and second sign post elongated slot 146 which extends substantially parallel to second sign post longitudinal axis 125 (see FIG. 4). The preferred first arcuate nesting component 126 is adapted to be slidingly received and removably secured by first sign post elongated slot 142, and the preferred second arcuate nesting component 128 is adapted to be slidingly received and removably secured by second sign post elongated slot 146. However, it is contemplated within the scope of the invention that the preferred arcuate nesting components may be secured to the sign posts by any suitable means such as welding, threaded fasteners, rivets, adhesives and the like. It is also contemplated within the scope of the invention that the preferred sign posts do not include elongated slots. It is further contemplated within the scope of the invention that the preferred arcuate nesting components may be snap-fitted or press-fitted into an elongated slot in a sign post or any other type of opening in a sign post such as a hole, a keyhole, a groove, a channel and the like.

As shown in FIG. 5, the preferred first sign panel 130 also has first sign panel first end 148 and first sign panel second end 150. The preferred first sign panel first end 131 is adapted to be retained by first arcuate nesting component 126 and the preferred first sign panel second end 132 is adapted to be retained by second arcuate nesting component 128. It is contemplated within the scope of the invention that the preferred sign panels may be removably or fixedly retained by the arcuate nesting components. The preferred first arcuate nesting component 126 includes first arcuate nesting component first flange 152 which is adapted to removably secure first sign panel first end 131. The preferred second arcuate nesting component 128 includes second arcuate nesting component first flange 154 adapted to removably secure first sign panel second end 132. As shown in FIG. 5, preferred sign assembly 120 also includes second sign panel 160 having second sign panel first end 161 and second sign panel second end 162. The preferred first arcuate nesting component 126 includes first arcuate nesting component second flange 164 which is adapted to removably secure second sign panel first end 161, and the preferred second arcuate nesting component 128 includes second arcuate nesting component second flange 166 which is adapted to removably secure second sign panel second end 162. It is contemplated within the scope of the invention that the second sign panel, like the first sign panel, may be removably or fixedly secured to the sign assembly and/or the arcuate nesting components.

Still referring to FIG. 5, the preferred first sign post 122 and the preferred first arcuate nesting component 126 are configured and arranged such that when the first arcuate nesting component is slidingly received and removably secured by first sign post elongated slot 142 there is substantially no gap between first sign panel first end 131 and first sign post 122, and the first arcuate nesting component extends around a portion of first sign post perimeter 140. Similarly, in the preferred sign assembly 120, when first arcuate nesting component 126 is slidingly received and removably secured by first sign post elongated slot 142, there is substantially no gap between second sign panel first end 161 and first sign post 122.

Further, as shown in FIG. 5, the preferred second sign post 124 and the preferred second arcuate nesting component 128 are configured and arranged such that when the second arcuate nesting component is slidingly received and removably secured by second sign post elongated slot 146 there is substantially no gap between first sign panel second end 132 and second sign post 124, and the second arcuate nesting component extends around a portion of second sign post perimeter 144. Similarly, in the preferred sign assembly 120, when second arcuate nesting component 128 is slidingly received and removably secured by second sign post elongated slot 146, there is substantially no gap between second sign panel second end 162 and second sign post 124. In the preferred sign assembly 120, the first arcuate nesting component extends around a substantial portion of first sign post perimeter 140, and the second arcuate nesting component extends around a substantial portion of second sign post perimeter 144. In a more preferred embodiment, the first arcuate nesting component extends around at least about 150° of first sign post perimeter 140, and the second arcuate nesting component extends around at least about 150° of second sign post perimeter 144.

Referring still to FIG. 5, the preferred sign assembly 120 also includes first support rib 170 and second support rib 172. The preferred first support rib 170 has first support rib first end 174 and first support rib second end 176. Preferably, first arcuate nesting component 126 includes first arcuate nesting component first arm 180 which is adapted to removably secure first support rib first end 174 and second arcuate nesting component 128 includes second arcuate nesting component first arm 182 which is adapted to removably secure the first support rib second end 176. The preferred second support rib 172 has second support rib first end 184 and second support rib second end 186. Preferably, first arcuate nesting component 126 includes first arcuate nesting component second arm 190 which is adapted to removably secure second support rib first end 184 and second arcuate nesting component 128 includes second arcuate nesting component second arm 192 which is adapted to removably secure second support rib second end 186. It is contemplated within the scope of the invention that the preferred support ribs may be removably or fixedly retained by the arcuate nesting components.

Figure 6:
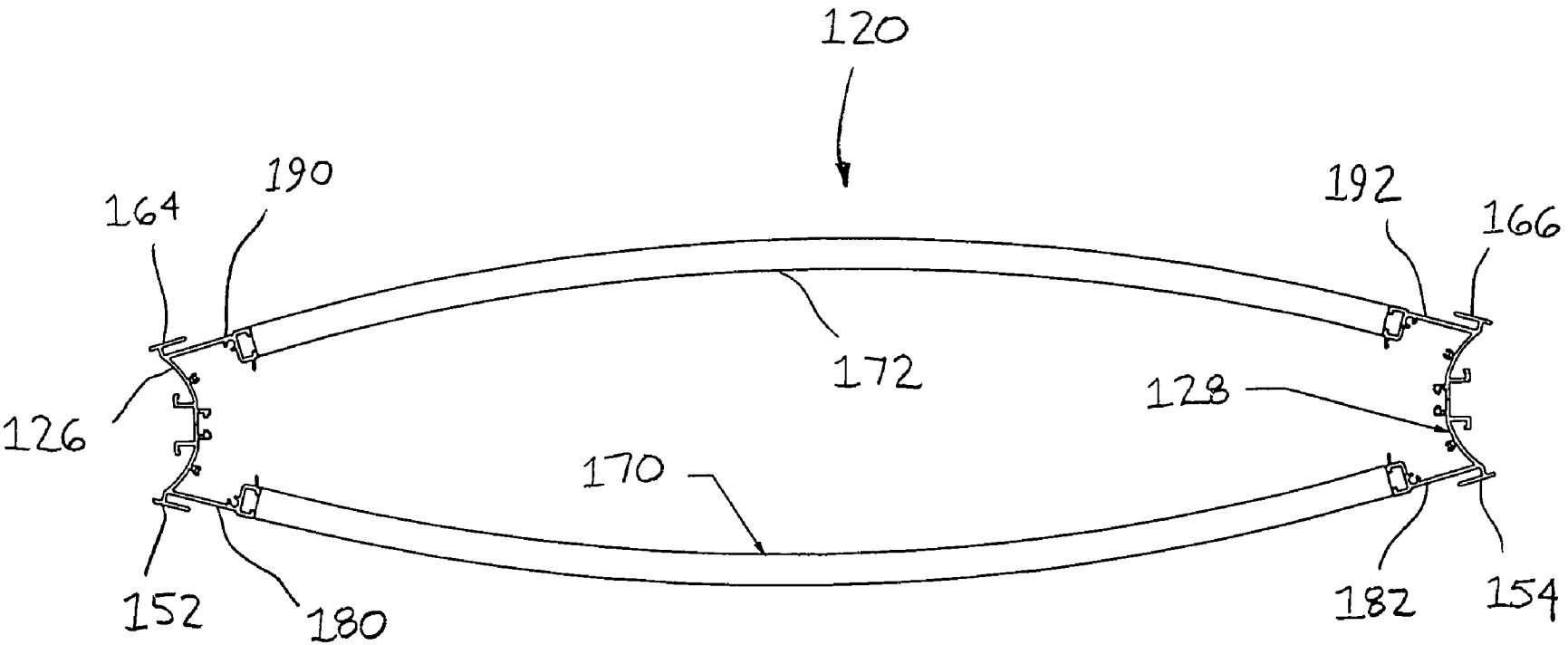
FIG. 6 is a top sectional view of the first alternative embodiment of the sign assembly illustrated by FIGS. 4-5 without the sign posts or the sign panels.

Referring now to FIG. 6, a top sectional view of preferred sign assembly 120 is illustrated without the sign posts or the sign panels in order to isolate first arcuate nesting component 126 and second arcuate nesting component 128.

Figure 7:
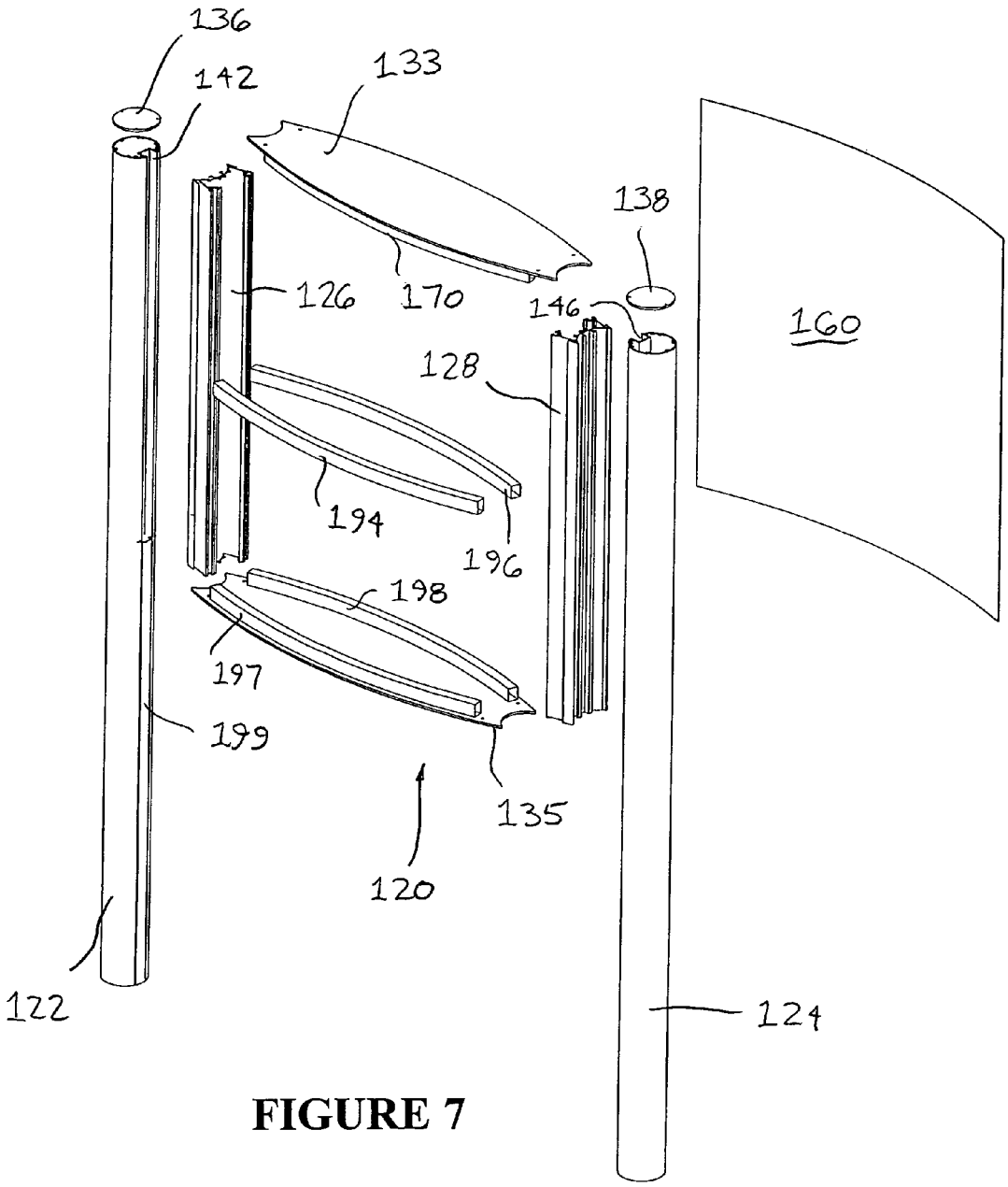
FIG. 7 is an exploded view of the first alternative embodiment of the sign assembly illustrated by FIGS. 4-6.

Referring now to FIG. 7, an exploded view of preferred sign assembly 120 is illustrated. As shown in FIG. 7, preferred sign assembly 120 further includes third support rib 194, fourth support rib 196, fifth support rib 197, sixth support rib 198 and filler 199 which is adapted to be slidingly received by first sign post elongated slot 142 and provide vertical support to first arcuate nesting component 126.

Referring now to FIG. 8, a front view of a second alternative embodiment of the sign assembly in accordance with the present invention is illustrated. As shown in FIG. 8, the preferred sign assembly is designated generally by reference numeral 220. More particularly, the preferred sign assembly 220 includes first sign post 222, second sign post 224, first arcuate nesting component 231, second arcuate nesting component 232, third arcuate nesting component 233, fourth arcuate nesting component 234, fifth arcuate nesting component 235, sixth arcuate nesting component 236, first sign panel 241, second sign panel 242, third sign panel 243, sign panel top plate 246, sign panel bottom plate 248, first sign panel intermediate plate 250, second sign panel intermediate plate 252 and sign post end cap 256. As shown in FIG. 8, preferred sign assembly 220 includes more than two sign panels. Further, the plurality of sign panels of preferred sign assembly 220 are separated by intermediate plates 250 and 252. Still further, in the preferred sign assembly 220, intermediate plates 250 and 252, as well as top plate 246 and bottom plate 248, are not symmetrically disposed between first sign post 222 and second sign post 224. Indeed, in preferred sign assembly 220, intermediate plates 250 and 252, top plate 246 and bottom plate 248 surround second sign post 224. It is contemplated within the scope of the invention that the top plate, bottom plate and/or intermediate plate(s) may surround more than one sign post/end cap and have any suitable configuration.

Referring now to FIG. 9, a right side view of the preferred sign assembly 220 is illustrated. FIG. 10 is a top view of the preferred sign assembly 220. As shown in FIGS. 9 and 10, the preferred top plate 246, the preferred bottom plate 248 and the preferred intermediate plates 250 and 252 extend laterally beyond the surface of the sign panels. As shown in FIG. 10, preferred sign assembly includes second post end cap 258. As shown in FIG. 9, preferred sign assembly 220 includes fourth sign panel 264, fifth sign panel 265 and sixth sign panel 266.

Figure 11:
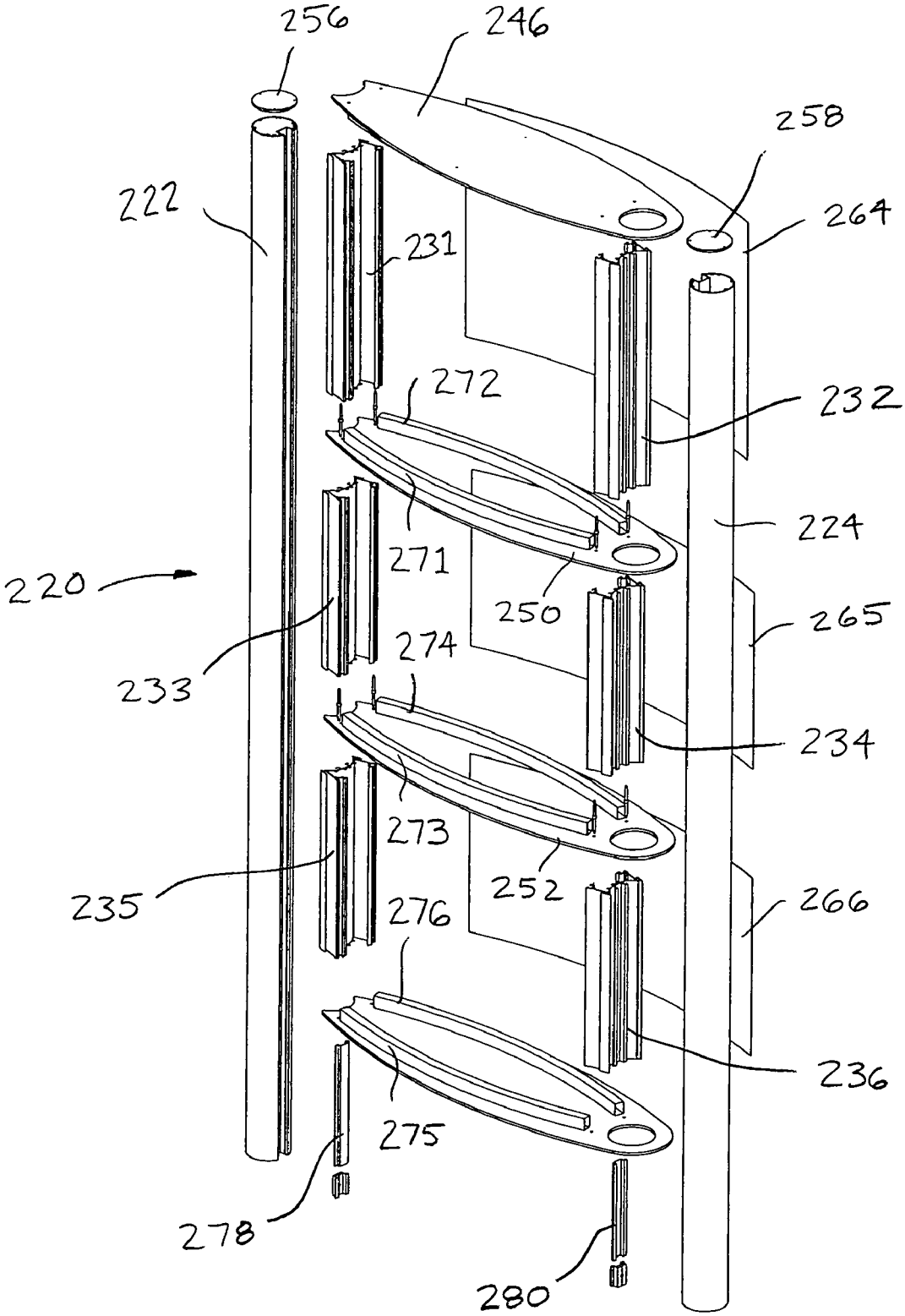
FIG. 11 is an exploded view of the second alternative embodiment of the sign assembly illustrated by FIGS. 8-10.

Referring now to FIG. 11, an exploded view of the preferred sign assembly 220 is illustrated. As shown in FIG. 11, preferred sign assembly 220 includes first support rib 271, second support rib 272, third support rib 273, fourth support rib 274, fifth support rib 275 and sixth support rib 276. The preferred sign assembly 220 also includes first filler 278 and second filler 280.

In use, several advantages of the invention are achieved. For example, the preferred embodiments of the invention provide a sign assembly having arcuate nesting components that extend around a portion of the perimeter of the sign post and along substantially the length of an end of the sign panel. The preferred embodiments of the invention also provide a sign assembly having improved structural stability and strength and substantially no gap between the end of the sign panel and the nearest sign post. Further, the preferred embodiments of the invention to provide a sign assembly that deflects air loads.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A sign assembly, said sign assembly comprising:

(a) a first sign post, said first sign post having a first sign post perimeter and a first sign post longitudinal axis;

(b) a first arcuate nesting component, said first arcuate nesting component being adapted to be secured to the first sign post and said first arcuate nesting component including a first flange adapted to secure a first sign panel first end and a first arcuate nesting component second flange adapted to secure a first end of a second sign panel, and said first arcuate nesting component also including a first arcuate nesting component first arm adapted to secure a first end of a first support rib and a first arcuate nesting component second arm adapted to secure a first end of a second support rib;

(c) a bracket adapted to secure a second end of the first support rib, a second end of the second support rib, a first sign panel second end and a second sign panel second end;

wherein the first sign post and the first arcuate nesting component are configured and arranged such that when the first arcuate nesting component is secured to the first sign post the first arcuate nesting component extends around a portion of the first sign post perimeter.

2. The sign assembly of claim 1 wherein the first sign post includes a first sign post elongated slot extending substantially parallel to the first sign post longitudinal axis, and wherein the first arcuate nesting component is adapted to be secured to the first sign post elongated slot.

3. The sign assembly of claim 2 wherein the first arcuate nesting component is adapted to be slidingly received and removably secured by the first sign post elongated slot.

4. The sign assembly of claim 1 wherein the first arcuate nesting component extends around a substantial portion of the first sign post perimeter.

5. The sign assembly of claim 1 wherein the first arcuate nesting component extends around at least about 150° of the first sign post perimeter.

6. The sign assembly of claim 1 wherein the first arcuate nesting component extends substantially along the first sign panel first end.

7. The sign assembly of claim 1 further comprising a sign panel top plate.

8. The sign assembly of claim 1 further comprising a sign panel bottom plate.

9. The sign assembly of claim 1 further comprising a sign post end cap.

10. A sign assembly, said sign assembly comprising:

(a) a first sign post, said first sign post having a first sign post perimeter and a first sign post longitudinal axis;

(b) a second sign post, said second sign post having a second sign post perimeter and a second sign post longitudinal axis;

(c) a first arcuate nesting component, said first arcuate nesting component being adapted to be secured to the first sign post;

(d) a second arcuate nesting component, said second arcuate nesting component being adapted to be secured to the second sign post;

(e) a first sign panel, said first sign panel having a first sign panel first end and a first sign panel second end, said first sign panel first end being adapted to be retained by the first arcuate nesting component and the first sign panel second end being adapted to be retained by the second arcuate nesting component;

(f) a first support rib, said first support rib having a first support rib first end and a first support rib second end;

(g) a second support rib, said second support rib having a second support rib first end and a second support rib second end;

wherein the first sign post and the first arcuate nesting component are configured and arranged such that when the first arcuate nesting component is secured to the first sign post the first arcuate nesting component extends around a portion of the first sign post perimeter, and wherein the second sign post and the second arcuate nesting component are configured and arranged such that when the second arcuate nesting component is secured to the second sign post the second arcuate nesting component extends around a portion of the second sign post perimeter; and wherein the first arcuate nesting component includes a first arcuate nesting component first arm adapted to secure the first support rib first end, and the second arcuate nesting component includes a second arcuate nesting component first arm adapted to secure the first support rib second end; and wherein the first arcuate nesting component includes a first arcuate nesting component second arm adapted to secure the second support rib first end, and the second arcuate nesting component includes a second arcuate nesting component second arm adapted to secure the second support rib second end.

11. The sign assembly of claim 10 wherein the first sign post includes a first sign post elongated slot extending substantially parallel to the first sign post longitudinal axis and the first arcuate nesting component is adapted to be secured to the first sign post elongated slot, and wherein the second sign post includes a second sign post elongated slot extending substantially parallel to the second sign post longitudinal axis and the second arcuate nesting component is adapted to be secured to the second sign post elongated slot.

12. The sign assembly of claim 11 wherein the first arcuate nesting component is adapted to be slidingly received and removably secured by the first sign post elongated slot, and the second arcuate nesting component is adapted to be slidingly received and removably secured by the second sign post elongated slot.

13. The sign assembly of claim 10 wherein the first arcuate nesting component extends around a substantial portion of the first sign post perimeter, and the second arcuate nesting component extends around a substantial portion of the second sign post perimeter.

14. The sign assembly of claim 10 wherein the first arcuate nesting component extends around at least about 150° of the first sign post perimeter, and the second arcuate nesting component extends around at least about 150° of the second sign post perimeter.

15. The sign assembly of claim 10 wherein the first arcuate nesting component extends substantially along the first sign panel first end.

16. The sign assembly of claim 15 wherein the second arcuate nesting component extends substantially along the first sign panel second end.

17. The sign assembly of claim 10 wherein the first arcuate nesting component includes a first arcuate nesting component first flange adapted to secure the first sign panel first end, and the second arcuate nesting component includes a second arcuate nesting component first flange adapted to secure the first sign panel second end.

18. The sign assembly of claim 10 further comprising:

(a) a second sign panel, said second sign panel having a second sign panel first end and a second sign panel second end;

wherein the first arcuate nesting component includes a first arcuate nesting component second flange adapted to secure the second sign panel first end, and the second arcuate nesting component includes a second arcuate nesting component second flange adapted to secure the second sign panel second end, and wherein the second sign post and the second arcuate nesting component are configured and arranged such that when the second arcuate nesting component is secured to the second sign post there is substantially no gap between the second sign panel second end and the second sign post.

19. The sign assembly of claim 10 further comprising a sign panel top plate.

20. The sign assembly of claim 10 further comprising a sign panel bottom plate.

21. The sign assembly of claim 10 further comprising a sign panel intermediate plate.

22. The sign assembly of claim 10 further comprising a first sign post end cap and a second sign post end cap.

* * * * *